US012410025B2

(12) United States Patent
Ando

(10) Patent No.: US 12,410,025 B2
(45) Date of Patent: Sep. 9, 2025

(54) SHEET STORAGE DEVICE AND IMAGE FORMATION SYSTEM INCLUDING SAME

(71) Applicant: KYOCERA Document Solutions Inc., Osaka (JP)

(72) Inventor: Satoshi Ando, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 18/731,594

(22) Filed: Jun. 3, 2024

(65) Prior Publication Data

US 2024/0400327 A1 Dec. 5, 2024

(30) Foreign Application Priority Data

Jun. 5, 2023 (JP) ..... 2023-092369

(51) Int. Cl.

| | |
|---|---|
| ***B65H 1/26*** | (2006.01) |
| ***B65H 1/04*** | (2006.01) |
| *B65H 1/14* | (2006.01) |

(52) U.S. Cl.

CPC ..... *B65H 1/266* (2013.01); *B65H 1/04* (2013.01); *B65H 1/14* (2013.01); *B65H 2220/01* (2013.01); *B65H 2220/04* (2013.01); *B65H 2403/411* (2013.01); *B65H 2405/1142* (2013.01); *B65H 2511/12* (2013.01); *B65H 2511/20* (2013.01); *B65H 2511/22* (2013.01); *B65H 2701/1315* (2013.01)

(58) Field of Classification Search

CPC ..... B65H 9/101; B65H 2403/411; B65H 2511/12; B65H 2511/11; B65H 2405/1122; B65H 2405/1142; B65H 2405/11425; B65H 1/266

See application file for complete search history.

(56) References Cited

U.S. PATENT DOCUMENTS

2022/0234846 A1* 7/2022 Ando ..... B65H 1/26

FOREIGN PATENT DOCUMENTS

JP H 06-115716 A 4/1994

* cited by examiner

*Primary Examiner* — Jeremy R Severson
(74) *Attorney, Agent, or Firm* — Stein IP, LLC

(57) ABSTRACT

A sheet storage device includes a regulation cursor and a hold mechanism. The hold mechanism includes a guide shaft, and a stopper having a guide hole in which the guide shaft is inserted, and being capable of reciprocating with the regulation cursor. When the stopper is inclined to one side, movement of the regulation cursor is restricted. When the stopper is raised to the other side, movement of the regulation cursor is enabled. The stopper has a contact part that contacts the regulation cursor, so as to restrict the stopper from inclining to the other side, when the regulation cursor is enabled to move.

8 Claims, 12 Drawing Sheets

SHEET STORAGE DEVICE AND IMAGE FORMATION SYSTEM INCLUDING SAME

INCORPORATION BY REFERENCE

This application is based upon and claims the benefit of priority from the corresponding Japanese Patent Application No. 2023-092369 filed Jun. 5, 2023, the entire contents of which are hereby incorporated by reference.

BACKGROUND

The present disclosure relates to a sheet storage device and an image formation system including the same.

A conventional sheet storage device is equipped with a regulation cursor that regulates positional deviation of a sheet. The regulation cursor can be moved by a user's operation, and stops in a state where it contacts an edge of the sheet, so as to regulate positional deviation of the sheet.

A conventional regulation cursor is capable of engaging with a concave-convex shape formed at a predetermined pitch in a moving direction of the regulation cursor, for example. By allowing the regulation cursor to engage with the concave-convex shape, the regulation cursor can be held in a stationary state.

SUMMARY

A sheet storage device according to a first aspect of the present disclosure includes a setting plate, a regulation cursor, and a hold mechanism. The setting plate is used for setting sheets thereon. The regulation cursor is supported in a manner capable of reciprocating in a horizontal direction, and contacts an edge of the sheet on the setting plate from a predetermined direction, so as to regulate positional deviation of the sheet in the predetermined direction. The hold mechanism stationarily holds the regulation cursor. The hold mechanism includes a guide shaft and a stopper. The guide shaft extends in the predetermined direction. The stopper is linked with the regulation cursor, and has a guide hole in which the guide shaft is inserted, so as to be capable of reciprocating with the regulation cursor along the guide shaft. The stopper is capable of inclining to one side in the predetermined direction on a fulcrum of a hole side end part having the guide hole. When the stopper is inclined to the one side, an inner edge of the guide hole contacts the guide shaft so as to generate frictional resistance, which restricts movement of the regulation cursor with the stopper, and when the stopper is raised to the other side opposite to the one side from the state where movement of the regulation cursor is restricted, the regulation cursor is enabled to move with the stopper. The stopper has a contact part. The contact part contacts the regulation cursor, so as to restrict the stopper from inclining to the other side, when the regulation cursor is enabled to move.

An image formation system according to a second aspect of the present disclosure includes the sheet storage device described above, and an image forming apparatus. The image forming apparatus is linked with the sheet storage device. The sheet storage device feeds the image forming apparatus with the sheet. The image forming apparatus performs printing on the sheet fed from the sheet storage device.

DETAILED DESCRIPTION

Hereinafter, with reference to FIGS. 1 to 12, a sheet storage device 100 according to an embodiment of the present disclosure and an image formation system 100S including the same are described.

<Structure of Image Formation System>

Figure 1:
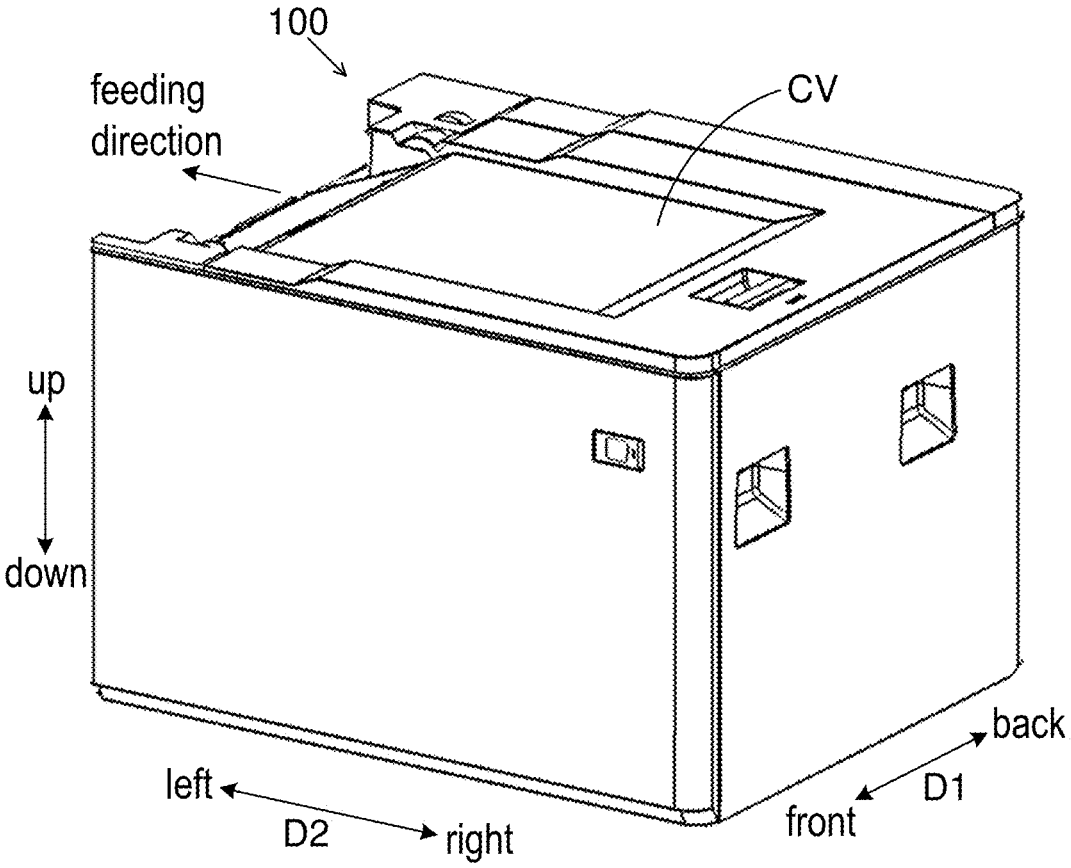
FIG. 1 is a perspective view of a sheet storage device according to an embodiment.
Figure 2:
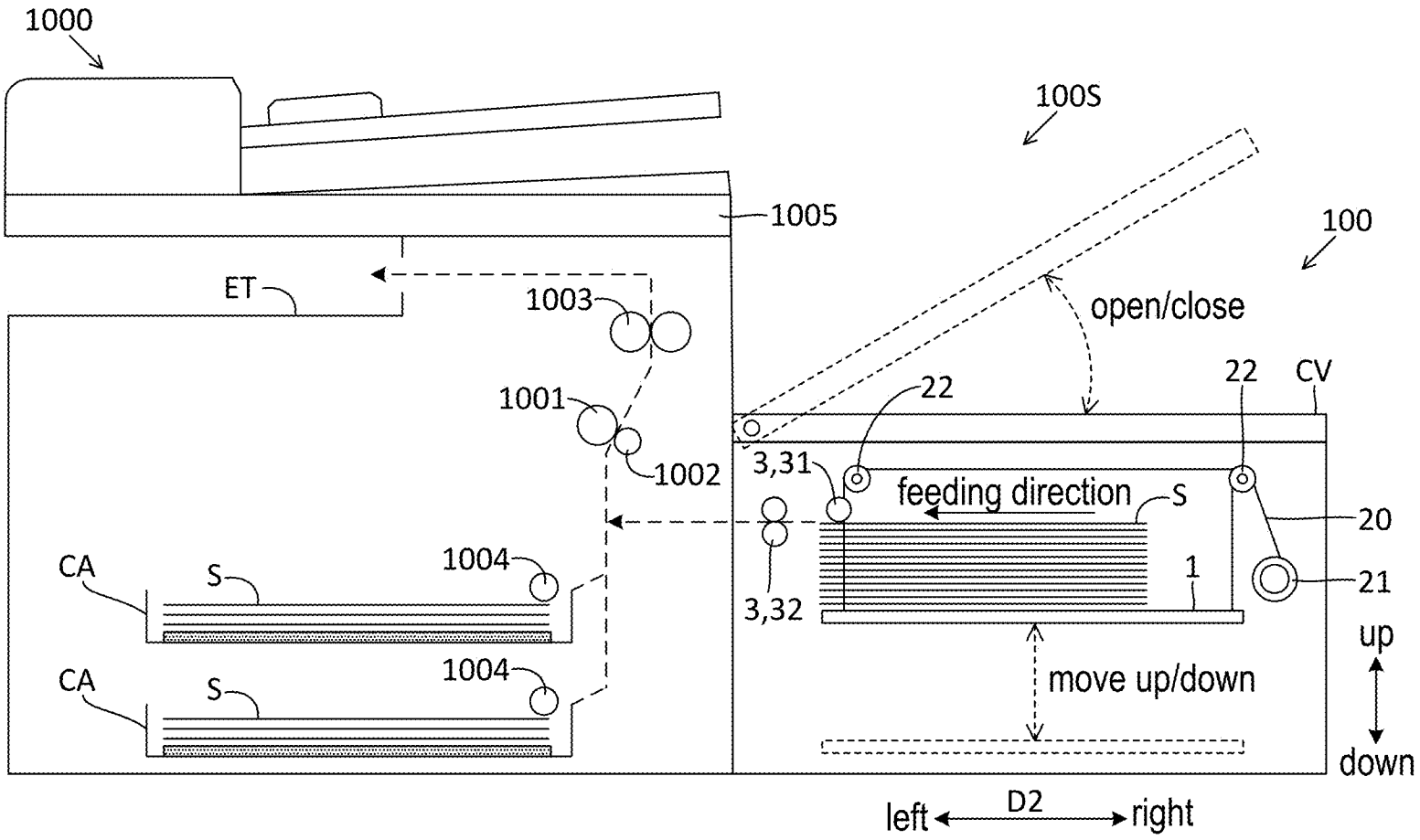
FIG. 2 is a schematic diagram of an image formation system including the sheet storage device according to the embodiment.

The sheet storage device 100 has an appearance as illustrated in FIG. 1. The sheet storage device 100 is linked with an image forming apparatus 1000 as illustrated in FIG. 2. When being linked with the image forming apparatus 1000, the sheet storage device 100 constitutes the image formation system 100S with the image forming apparatus 1000. FIG. 2 is a schematic diagram of the image formation system 100S (i.e., the sheet storage device 100 linked with the image forming apparatus 1000). FIG. 2 corresponds to a case where the image formation system 100S is viewed from front.

The sheet storage device 100 is installed with the image forming apparatus 1000 on a floor. The direction perpendicular to the floor (a flat surface) on which the sheet storage device 100 is installed corresponds to an "up and down direction".

Here, in horizontal directions perpendicular to the up and down direction, one direction corresponds to a "first direction", and the other direction perpendicular to the one direction corresponds to a "second direction". In the following description, the one direction of the horizontal directions is denoted by D1 and is simply referred to as a first direction D1, while the other direction of the horizontal directions is denoted by D2 and is simply referred to as a second direction D2.

The first direction D1 corresponds to a front and back direction when viewing the sheet storage device 100 from front. One side in the first direction D1 is a front side (i.e., a near side when viewing the device from front), and the other side opposite to the one side in the first direction D1 is a back side (i.e., a far side when viewing the device from front).

The second direction D2 corresponds to a left and right direction when viewing the sheet storage device 100 from front. One side in the second direction D2 is a right side, and the other side opposite to the one side in the second direction D2 is a left side.

Note that the first direction D1 and the second direction D2 each correspond to a "predetermined direction". The front side in the first direction D1 corresponds to "one side in a predetermined direction", and the back side in the first direction D1 corresponds to "the other side in a predetermined direction". The right side in the second direction D2 corresponds to "one side in a predetermined direction", and the left side in the second direction D2 corresponds to "the other side in a predetermined direction".

The sheet storage device 100 is attachable and detachable from the image forming apparatus 1000. The sheet storage device 100 may be an optional device. The sheet storage device 100 is disposed on the right side of the image forming apparatus 1000.

The sheet storage device 100 stores sheets S. For instance, the sheet S is a paper sheet. The sheet storage device 100 feeds the sheet S to the image forming apparatus 1000. In other words, the sheet storage device 100 functions as a feeding device.

On the right side of the image forming apparatus 1000, the sheet storage device 100 feeds the sheet S to the image forming apparatus 1000, from the right side to the left side. In other words, in the second direction D2, the direction from the right side to the left side is a feeding direction of the sheet S from the sheet storage device 100 to the image forming apparatus 1000. In this structure, the first direction D1 is a direction perpendicular to the feeding direction of the sheet S.

The image forming apparatus 1000 prints an image on the sheet S fed from the sheet storage device 100. A printing method of the image forming apparatus 1000 is an electrophotographic method. It may also be possible that the printing method of the image forming apparatus 1000 is an inkjet method.

<Structure of Image Forming Apparatus>

The image forming apparatus 1000 conveys the sheet S fed from the sheet storage device 100, along a conveying path. The image forming apparatus 1000 prints an image on the sheet S under conveyance. Note that the conveying path of the sheet S is shown by a broken line with an arrow in FIG. 2.

The image forming apparatus 1000 includes a photosensitive drum 1001 and a transfer roller 1002. The photosensitive drum 1001 carries a toner image on its outer circumference surface. The transfer roller 1002 is pressed to contact the photosensitive drum 1001, so as to form a transfer nip with the photosensitive drum 1001. The transfer roller 1002 rotates together with the photosensitive drum 1001. When the sheet S under conveyance enters in the transfer nip, a transfer process is performed on the sheet S, and the toner image is transferred onto the sheet S.

Although not illustrated, the image forming apparatus 1000 further includes a charging device, an exposure device, and a development device. The charging device charges the outer circumference surface of the photosensitive drum 1001. The exposure device forms an electrostatic latent image on the outer circumference surface of the photosensitive drum 1001. The development device develops the electrostatic latent image on the outer circumference surface of the photosensitive drum 1001 into the toner image.

The image forming apparatus 1000 includes a fixing roller pair 1003. The fixing roller pair 1003 includes a heating roller and a pressure roller. A heater is embedded in the heating roller. The pressure roller is pressed to contact the heating roller so as to form a fixing nip with the heating roller. The pressure roller rotates with the heating roller. When the sheet S under conveyance enters the fixing nip, a fixing process is performed on the sheet S, and the toner image is fixed to the sheet S. The sheet S after passing through the fixing nip is discharged onto a discharge tray ET.

Note that the image forming apparatus 1000 includes a feed roller 1004. The feed roller 1004 feeds the sheet S to the conveying path from a sheet cassette CA disposed in a main body of the image forming apparatus 1000. In other words, the image forming apparatus 1000 can also print on the sheet S set in the sheet cassette CA.

In addition, the image forming apparatus 1000 includes an image reading device 1005. The image reading device 1005 reads an original so as to generate image data of the original. The image forming apparatus 1000 can print an image based on the image data of the original on the sheet S (i.e., can copy the original).

<Structure of Sheet Storage Device>

Figure 3:
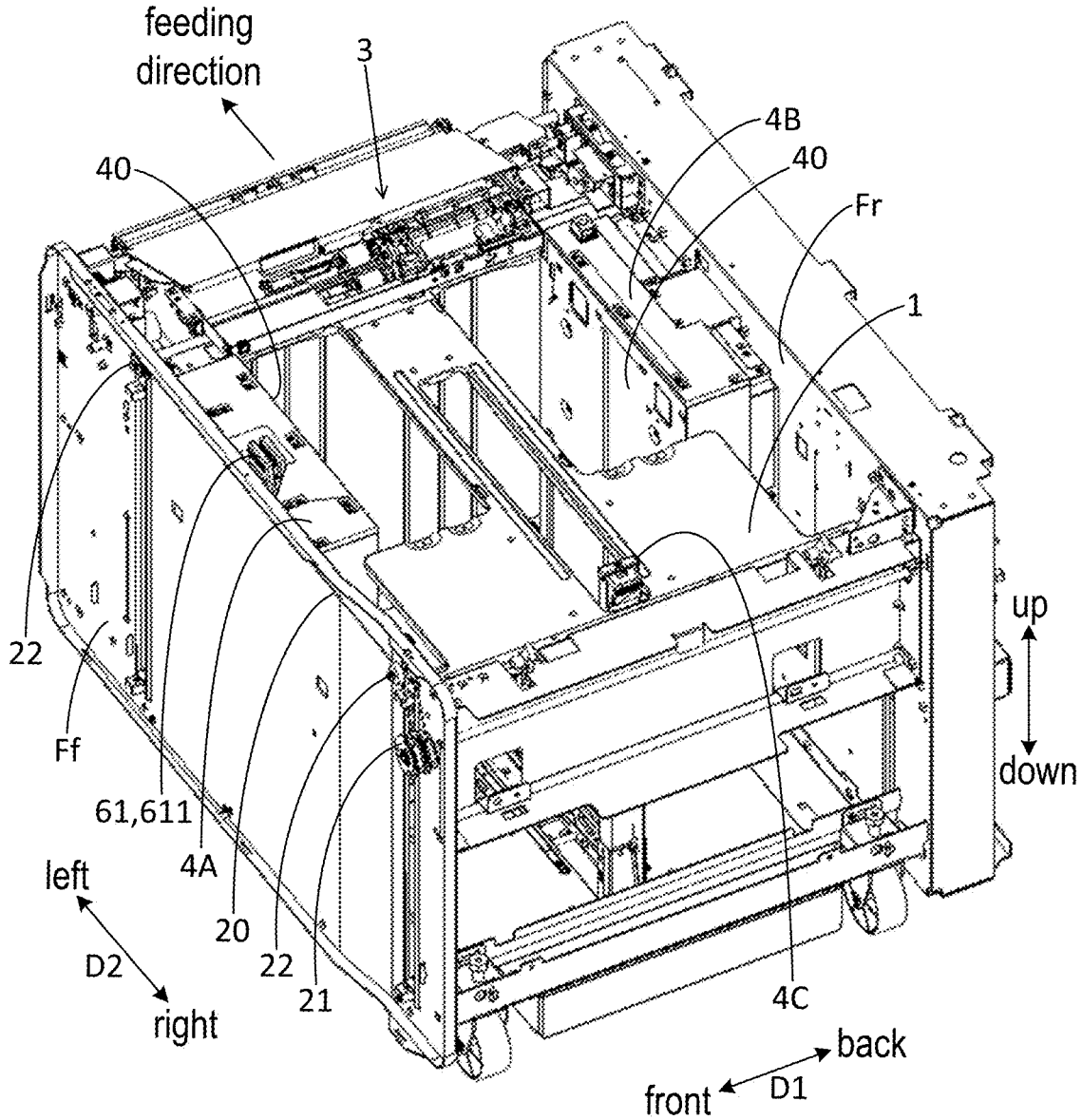
FIG. 3 is a perspective view of the sheet storage device according to the embodiment, without an outer cover.

As illustrated in FIG. 3, the sheet storage device 100 has a front frame Ff and a rear frame Fr. The front frame Ff and the rear frame Fr are made of sheet metal. The front frame Ff is disposed on the front side, and the rear frame Fr is disposed on the back side. The front frame Ff has a front surface part whose thickness direction is the first direction D1, and the rear frame Fr has a rear surface part whose thickness direction is the first direction D1. The front frame Ff and the rear frame Fr are disposed in such a manner that the front surface part and the rear surface part face each other in the first direction D1.

The sheet storage device 100 has a sheet storage region, which is a region between the front frame Ff and the rear frame Fr in the first direction D1. The sheet storage region is covered with a top cover CV from above (see FIGS. 1 and 2).

The top cover CV is supported in a pivotable manner with respect to the front frame Ff and the rear frame Fr. The top cover CV is pivotable about an axis extending in the first direction D1. The top cover CV pivots on a fulcrum of the left side end part so as to move the right side end part upward and downward. In other words, the top cover CV opens and closes an upper opening of the sheet storage region.

When the right side end part of the top cover CV is moved upward (in other words, when opening the top cover CV), the upper opening of the sheet storage region is exposed. Further, in the state where the top cover CV is opened, the sheets S are put in the sheet storage region through the upper opening of the sheet storage region. In this state, the right side end part of the top cover CV is moved downward (in other words, the top cover CV is closed), and thus the upper opening of the sheet storage region is closed.

The sheet storage device 100 includes a setting plate 1. The setting plate 1 is made of metal sheet. The setting plate 1 is disposed in the sheet storage region. The sheets S are set on the setting plate 1. The sheets S are stacked in the up and down direction. The setting plate 1 is supported in a manner capable of reciprocating in the up and down direction.

Figure 4:
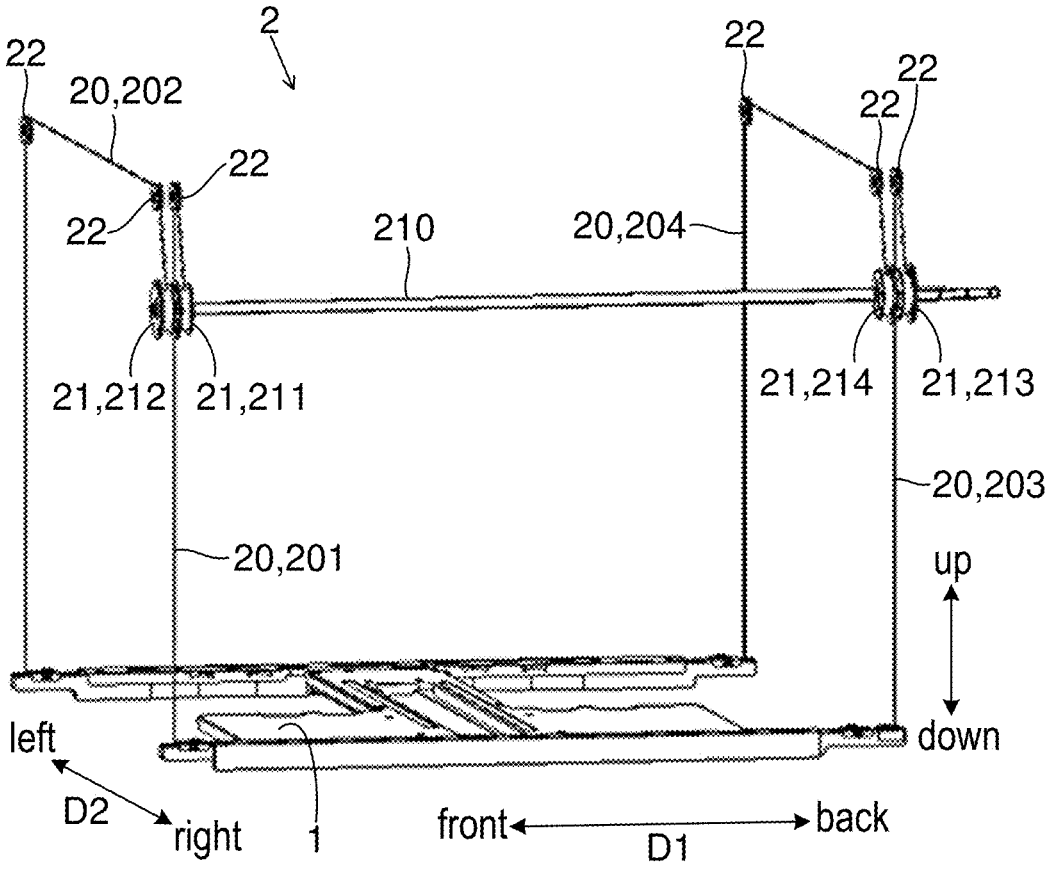
FIG. 4 is a perspective view of an elevating mechanism of a setting plate in the sheet storage device according to the embodiment.
Figure 5:
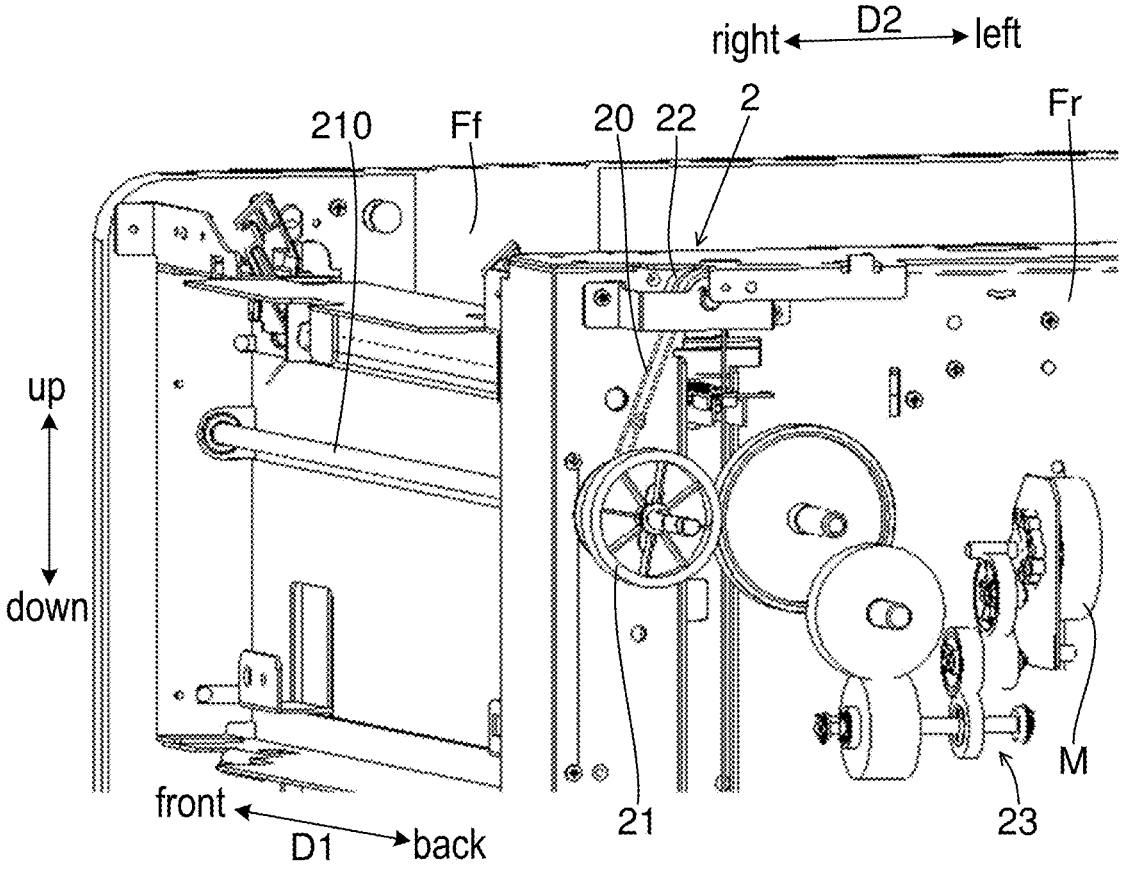
FIG. 5 is a perspective view of a winding motor and its vicinity of the elevating mechanism illustrated in FIG. 4.

The sheet storage device 100 includes an elevating mechanism 2. A structure of the elevating mechanism 2 is illustrated in FIGS. 4 and 5. The elevating mechanism 2 moves the setting plate 1 in the up and down direction. The elevating mechanism 2 moves the setting plate 1 upward, so as to keep a position in the up and down direction of the top one of the sheets S set on the setting plate 1.

The elevating mechanism 2 includes wires 20 linked with the setting plate 1. The wires 20 include a first wire 201 whose one end is linked with a right front side end part of the setting plate 1, a second wire 202 whose one end is linked with a left front side end part of the setting plate 1, a third wire 203 whose one end is linked with a right back side end part of the setting plate 1, and a fourth wire 204 whose one end is linked with a left back side end part of the setting plate 1. The elevating mechanism 2 winds or unwinds the wires 20 so as to move the setting plate 1 upward or downward.

The elevating mechanism 2 includes winding drums 21, relay pulleys 22, and a winding motor M. The winding drums 21 includes a first winding drum 211 linked with the other end of the first wire 201, a second winding drum 212 linked with the other end of the second wire 202, a third winding drum 213 linked with the other end of the third wire 203, and a fourth winding drum 214 linked with the other end of the fourth wire 204. When each of the first to fourth winding drums 211 to 214 rotates forward, it winds the wire 20 linked with itself, while when it rotates backward, it unwinds the wire 20 linked with itself.

The first winding drum 211 and the second winding drum 212 are disposed outward in the first direction D1 of the front frame Ff. The third winding drum 213 and the fourth winding drum 214 are disposed outward in the first direction D1 of the rear frame Fr. Note that "outward in the first direction D1" means the direction from the center of sheet storage region in the first direction D1 toward the front side or the back side in the first direction D1. In other words, "outward in the first direction D1 of the front frame Ff" means the opposite side of the sheet storage region side in the first direction D1 of the front frame Ff (i.e., the front side of the front frame Ff), and "outward in the first direction D1 of the rear frame Fr" means the opposite side of the sheet storage region side in the first direction D1 of the rear frame Fr (i.e., the back side of the rear frame Fr).

The first winding drum 211 and the second winding drum 212 are arranged in this order from the front frame Ff side outward in the first direction D1. The fourth winding drum 214 and the third winding drum 213 are arranged in this order from the rear frame Fr side outward in the first direction D1.

The first to fourth winding drums 211 to 214 are supported in a rotatable manner about the same axis extending in the first direction D1. Specifically, the first to fourth winding drums 211 to 214 are attached to the same rotation shaft 210, and rotate together with the rotation shaft 210. One end part of the rotation shaft 210 in the axis direction is supported by the front frame Ff in a rotatable manner, and the other end part in the axis direction opposite to the one end part is supported by the rear frame Fr in a rotatable manner, so that the rotation shaft 210 extends in parallel to the first direction D1. The first winding drum 211 and the second winding drum 212 are disposed in the right side end part of the front frame Ff in the second direction D2, while the third winding drum 213 and the fourth winding drum 214 are disposed in the right side end part of the rear frame Fr in the second direction D2. In other words, one end part of the rotation shaft 210 is supported in a rotatable manner by the right side end part of the front frame Ff in the second direction D2, and the other end part of the rotation shaft 210 is supported in a rotatable manner by the right side end part of the rear frame Fr in the second direction D2.

When the winding motor M is driven, it rotates the rotation shaft 210. When the rotation shaft 210 rotates, the first to fourth winding drums 211 to 214 rotate. The winding motor M is disposed outward in the first direction D1 of the rear frame Fr. The winding motor M is linked with the back side end part of the rotation shaft 210 with a transmission mechanism 23 including a plurality of gears such as a screw gear.

Three relay pulleys 22 are disposed outward in the first direction D1 of the front frame Ff, and three relay pulleys 22 are disposed outward in the first direction of the rear frame Fr. The three relay pulleys 22 on the front side are supported by the front frame Ff in a rotatable manner, and the three relay pulleys 22 on the back side are supported by the rear frame Fr in a rotatable manner. Each of the relay pulleys 22 is disposed higher than the rotation shaft 210 in the up and down direction.

The first wire 201 extends from the setting plate 1, wraps around the one relay pulley 22, and reaches the first winding drum 211. The second wire 202 wraps around the two relay pulleys 22. One relay pulley 22 for the second wire 202 is positioned at the left side of the other relay pulley 22 for the second wire 202 in the second direction D2. The other relay pulley 22 for the second wire 202 rotates about the same axis as the relay pulley 22 for the first wire 201. The second wire 202 extends from the setting plate 1, wraps around the two relay pulleys 22, and reaches the second winding drum 212.

The third wire 203 extends from the setting plate 1, wraps around the one relay pulley 22, and reaches the third winding drum 213. The fourth wire 204 wraps around the two relay pulleys 22. One relay pulley 22 for the fourth wire 204 is positioned at the left side of the other relay pulley 22 for the fourth wire 204 in the second direction D2. The other relay pulley 22 for the fourth wire 204 rotates about the same axis as the relay pulley 22 for the third wire 203. The fourth wire 204 extends from the setting plate 1, wraps around the two relay pulleys 22, and reaches the fourth winding drum 214.

When the winding motor M rotates forward, the winding drum 21 winds the wire 20. In this way, the setting plate 1 moves upward. On the other hand, when the winding motor M rotates backward, the wire 20 is unwound from the winding drum 21. In this way, the setting plate 1 moves downward.

As illustrated in FIGS. 2 and 3, the sheet storage device 100 includes a feeding unit 3. The feeding unit 3 feeds the sheet S from the sheet storage device 100 (i.e., the sheet storage region) to the image forming apparatus 1000. The feeding unit 3 includes a pickup roller 31 and a conveying roller pair 32.

The pickup roller 31 is supported in a rotatable manner. The pickup roller 31 is disposed at a position capable of contacting a downstream side end part of the sheet S in the feeding direction from above, in the state where the sheet S is set on the setting plate 1. The pickup roller 31 is supported in a rotatable manner. The pickup roller 31 contacts the sheet S set on the setting plate 1 from above and rotates in this state, so as to pull out the sheet S from the setting plate 1.

The conveying roller pair 32 is supported in a rotatable manner. The conveying roller pair 32 is a pair of rollers that are pressed to contact each other. The conveying roller pair 32 is disposed on the downstream side of the pickup roller 31 in the feeding direction. The conveying roller pair 32 pinches the sheet S pulled out from the setting plate 1 by the pickup roller 31, and rotates. In this way, the conveying roller pair 32 conveys the sheet S to the image forming apparatus 1000. The number of disposed conveying roller pairs 32 is not particularly limited, but it can be changed depending on factors such as a conveying path length for the sheet S from the pickup roller 31 to the image forming apparatus 1000.

The sheet S on the setting plate 1 is sent out from the right side to the left side in the second direction D2. In other words, on the setting plate 1, the left side end of the sheet S in the second direction D2 is a front end, while the right side end of the sheet S in the second direction D2 is a rear end. In addition, on the setting plate 1, the first direction D1 (i.e., the front and back direction) is a width direction of the sheet S.

Note that the elevating mechanism 2 moves the setting plate 1 upward, so as to allow the pickup roller 31 to contact the top one of the sheets S on the setting plate 1. In a case where the sheets S are fed continuously from the sheet storage device 100 to the image forming apparatus 1000, the elevating mechanism 2 repeats moving the setting plate 1 upward and stopping the same. In this way, the contact between the pickup roller 31 and the top one of the sheets S on the setting plate 1 is maintained.

Figure 6:
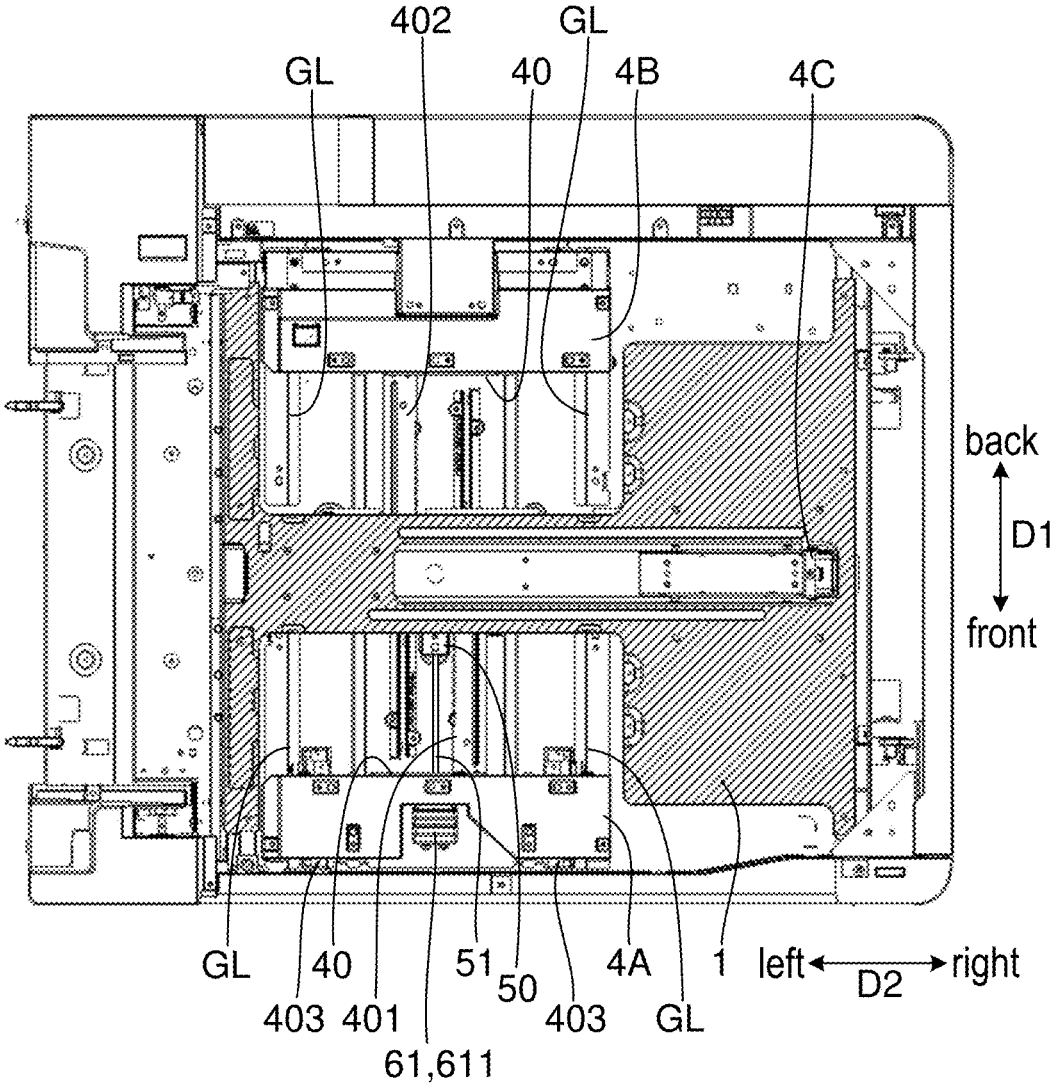
FIG. 6 is a plan view of a sheet storage region of the sheet storage device according to the embodiment, viewed from above.

As illustrated in FIG. 6, the sheet storage device 100 includes width direction regulation cursors 4A and 4B, and a rear end regulation cursor 4C. The width direction regulation cursor 4A, the width direction regulation cursor 4B, and the rear end regulation cursor 4C are supported in a manner capable of reciprocating in predetermined directions perpendicular to the up and down direction (i.e., in the horizontal direction). The width direction regulation cursor 4A, the width direction regulation cursor 4B, and the rear end regulation cursor 4C are moved in predetermined directions by user's operation. Then, the width direction regulation cursor 4A, the width direction regulation cursor 4B, and the rear end regulation cursor 4C contact edges of the sheet S set on the setting plate 1, from predetermined directions. In this way, the width direction regulation cursor 4A, the width direction regulation cursor 4B, and the rear end regulation cursor 4C regulate positional deviations in predetermined directions of the sheet S on the setting plate 1.

The width direction regulation cursors 4A and 4B move in the first direction D1, and contact the edges of the sheet S on the setting plate 1 in the first direction D1, so as to regulate a positional deviation in the first direction D1 of the sheet S on the setting plate 1. Note that the width direction regulation cursors 4A and 4B sandwich the sheet S on the setting plate 1 in the first direction D1. The rear end regulation cursor 4C moves in the second direction D2, and contacts the edge of the sheet S on the setting plate 1 in the second direction D2, so as to regulate a positional deviation in the second direction D2 of the sheet S on the setting plate 1.

Note that when viewing from above, the setting plate 1 has openings (no numeral) on moving paths of the width direction regulation cursors 4A and 4B, and an opening (no numeral) on a moving path of the rear end regulation cursor 4C. Therefore, when the width direction regulation cursors 4A and 4B move in the first direction D1, they do not contact the setting plate 1. When the rear end regulation cursor 4C moves in the second direction D2, it does not contact the setting plate 1. In other words, viewed from above, even if the sheet S is smaller than the setting plate 1, the width direction regulation cursors 4A and 4B can contact the edges of the sheet S without contacting the setting plate 1, and the rear end regulation cursor 4C can contact the edge of the sheet S without contacting the setting plate 1. In FIG. 6, the setting plate 1 is shown with hatching.

The width direction regulation cursor 4A contacts the edge of the sheet S from the front side in the first direction D1, and the width direction regulation cursor 4B contacts the edge of the sheet S from the back side in the first direction D1. Specifically, the width direction regulation cursors 4A and 4B each have a plate-like side surface part 40 that contacts the edge of the sheet S. The side surface part 40 of each of the width direction regulation cursors 4A and 4B stands in the up and down direction, and its thickness direction is the first direction D1. The side surface parts 40 of the width direction regulation cursors 4A and 4B face each other in the first direction D1.

The width direction regulation cursors 4A and 4B move in the first direction D1 in an interlocking manner. When the width direction regulation cursor 4A moves backward, the width direction regulation cursor 4B moves frontward, and hence an interval between the width direction regulation cursors 4A and 4B in the first direction D1 becomes smaller. When width direction regulation cursor 4A moves frontward, the width direction regulation cursor 4B moves backward, and hence the interval between the width direction regulation cursors 4A and 4B in the first direction D1 becomes larger.

Figure 7:
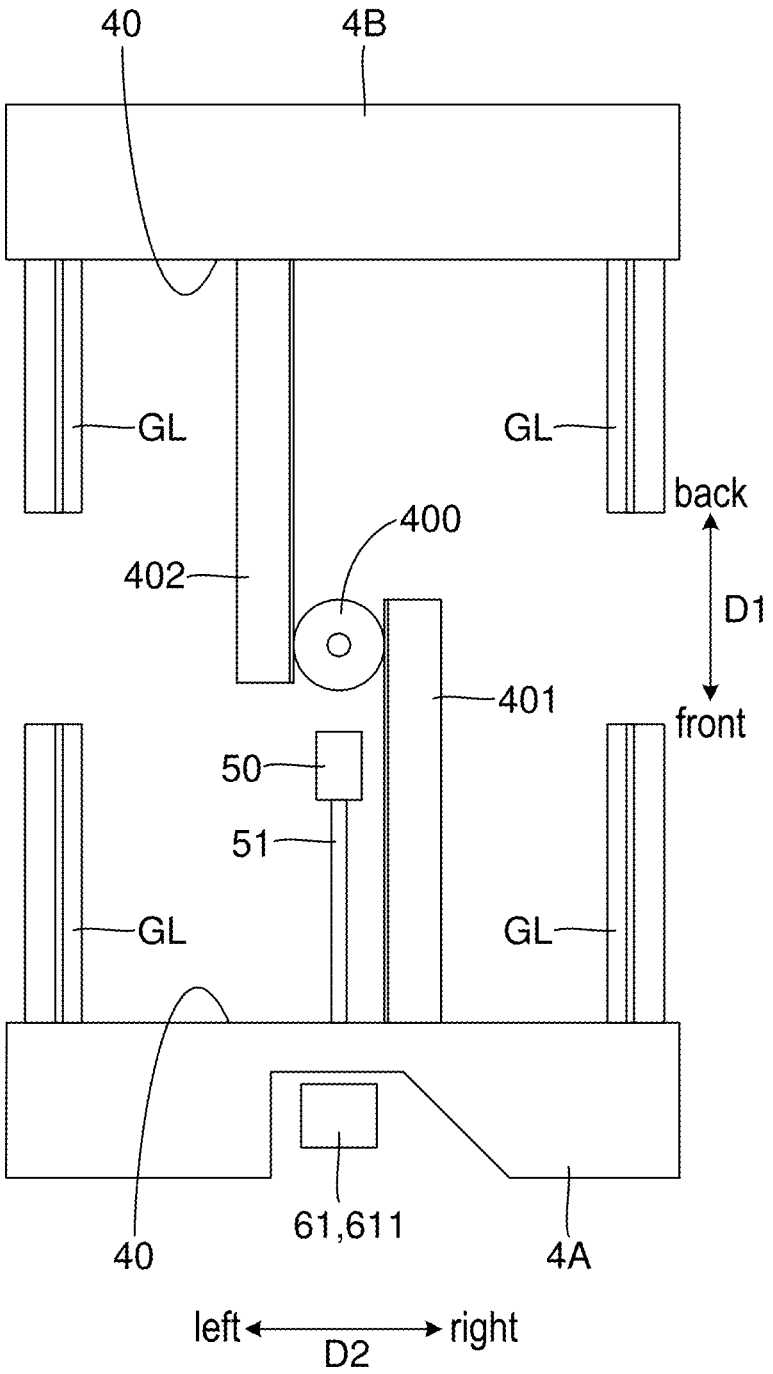
FIG. 7 is a schematic diagram (a plan view viewed from above) of a mechanism for moving a pair of width direction regulation cursors of the sheet storage device according to the embodiment.

In order to move the width direction regulation cursors 4A and 4B in the first direction D1 in an interlocking manner, as illustrated in FIG. 7, the width direction regulation cursor 4A is provided with a rack 401 that extends backward in the first direction D1, and the width direction regulation cursor 4B is provided with a rack 402 that extends frontward in the first direction D1. Between the racks 401 and 402 in the second direction D2, there is disposed a gear 400 that rotates about an axis extending in the up and down direction. The gear 400 engages with the racks 401 and 402.

Note that when moving the width direction regulation cursors 4A and 4B in the first direction D1, the user operates width direction regulation cursor 4A so as to move the width direction regulation cursor 4A in the first direction D1. In this structure, the width direction regulation cursor 4A corresponds to a "regulation cursor".

<Structure of Hold Mechanism>

As illustrated in FIGS. 8 to 12, the sheet storage device 100 includes a hold mechanism 5 that stationarily holds the width direction regulation cursor 4A at any position in the first direction D1. The hold mechanism 5 has a function of regulating positional deviation of the width direction regulation cursor 4A in the first direction D1. When the positional deviation of the width direction regulation cursor 4A is regulated, positional deviation of the width direction regulation cursor 4B is also regulated. In other words, the hold mechanism 5 stationarily holds not only the width direction regulation cursor 4A but also the width direction regulation cursor 4B at any position.

The width direction regulation cursor 4A has a plate-like bottom surface part 41 that extends from a lower end of the side surface part 40 frontward in the first direction D1. By bending a single metal sheet, the width direction regulation cursor 4A having the side surface part 40 and the bottom surface part 41 is formed. The bottom surface part 41 has a link opening 410. The link opening 410 is a through hole that penetrates the bottom surface part 41 in the thickness direction (i.e., the thickness direction of a plate-like part forming the bottom surface part 41).

The link opening 410 has a link protrusion 411 on its inside. The link protrusion 411 protrudes from an inner edge of the link opening 410 frontward in the first direction D1. The link protrusion 411 has a plate-like shape.

The hold mechanism 5 includes a guide shaft 51. The guide shaft 51 is a round bar. The guide shaft 51 extends in the first direction D1. The guide shaft 51 is disposed below the bottom surface part 41. One end part of the guide shaft 51 on the front side in the first direction D1 is fixed to an edge part of a bottom frame Fb, and the other end part of the same on the back side in the first direction D1 is fixed to an attaching part 50 provided to a bottom surface of the bottom frame Fb (see FIGS. 6 and 7). The bottom frame Fb is made of metal sheet and is a frame that forms a bottom part of the sheet storage device 100.

Note that a trolley member 403 is attached to the width direction regulation cursor 4A. The trolley member 403 includes a roller 403*a*, and can travel on the bottom surface of the bottom frame Fb in the first direction D1, together with the width direction regulation cursor 4A. For instance, the bottom surface of the bottom frame Fb (i.e., the upper surface) is provided with a guide rail GL. The guide rail GL guides the trolley member 403 to travel in the first direction D1.

The hold mechanism 5 includes a stopper 52. The stopper 52 is made of metal sheet. The stopper 52 is linked with the width direction regulation cursor 4A.

The stopper 52 has a guide hole 521. The guide hole 521 is a through hole penetrating the stopper 52 in the thickness direction (i.e., the thickness direction of a plate-like part forming the stopper 52). The guide hole 521 has a circular hole shape. The guide shaft 51 is fixed to the bottom frame Fb in a state inserted in the guide hole 521. The stopper 52 can reciprocate along the guide shaft 51 in the first direction D1 in the state where the guide shaft 51 is inserted in the guide hole 521.

In addition, the stopper 52 has an end part 5202 on the opposite side of a hole side end part 5201 having the guide hole 521, and allows the end part 5202 to protrude from the link opening 410 above the bottom surface part 41. The end part 5202 corresponds to an "operation side end part". In the following description, the end part 5202 is referred to as the operation side end part 5202.

The stopper 52 has a link hole 522 between the hole side end part 5201 and the operation side end part 5202. The link hole 522 is a through hole penetrating the stopper 52 in the thickness direction. The link protrusion 411 is inserted in the link hole 522 from the back side in the first direction D1. By allowing the operation side end part 5202 to protrude from the link opening 410 above the bottom surface part 41, and by inserting the link protrusion 411 in the link hole 522 from the back side in the first direction D1, the stopper 52 is linked with the width direction regulation cursor 4A. The stopper 52 can reciprocate in the first direction D1 together with the width direction regulation cursor 4A.

In addition, the hold mechanism 5 includes a coil spring 53. The coil spring 53 corresponds to a "biasing member". The coil spring 53 is a compression spring. The coil spring 53 is fitted over the guide shaft 51. For instance, a bracket 54 is attached to a lower surface of the bottom surface part 41. The bracket 54 is positioned on the front side of the stopper 52 in the first direction D1. In addition, the bracket 54 has a through hole (no numeral) in which the guide shaft 51 is inserted.

The coil spring 53 is sandwiched between the stopper 52 and the bracket 54 in the first direction D1. In this way, the coil spring 53 generates a biasing force that biases the stopper 52 backward in the first direction D1. The coil spring 53 biases the hole side end part 5201 backward in the first direction D1.

<Stationary Holding of Width Direction Regulation Cursor>

The guide hole 521 has an opening diameter larger than the diameter of the guide shaft 51. In this way, the stopper 52 can incline in the first direction D1 on a fulcrum of the hole side end part 5201. Here, the stopper 52 is biased backward in the first direction D1 at the hole side end part 5201 by the coil spring 53.

Figure 11:
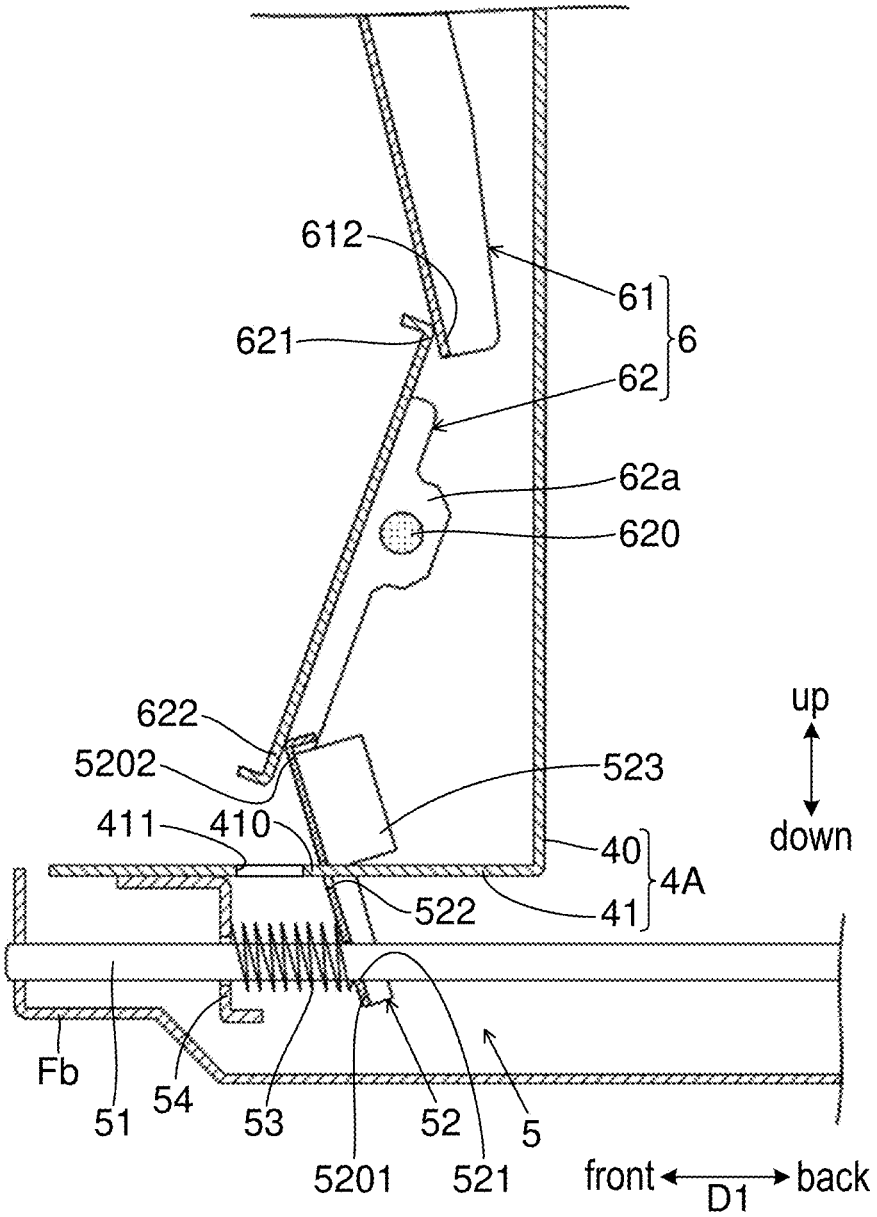
FIG. 11 is a cross-sectional view schematically illustrating a state where the stopper of the sheet storage device according to the embodiment is inclined.

Therefore, as illustrated in FIG. 11, when a lever 61 described later is not operated, the stopper 52 inclines on a fulcrum of the hole side end part 5201, to the front side in the first direction D1 (corresponding to "one side in a predetermined direction"). Note that as described later in detail, by operating the lever 61, the stopper 52 can be raised backward in the first direction D1 from the state where the stopper 52 is inclined frontward in the first direction D1.

By inclining the stopper 52 frontward in the first direction D1, an inner edge of the guide hole 521 contacts the guide shaft 51, and hence a frictional resistance occurs. Then, this frictional resistance restricts the stopper 52 from moving in the first direction D1. In addition, as the stopper 52 is linked with the width direction regulation cursor 4A, when the stopper 52 is restricted from moving in the first direction D1, the width direction regulation cursor 4A is restricted from moving in the first direction D1.

In this embodiment, the width direction regulation cursor 4A is moved in the first direction D1 so that the side surface part 40 of the width direction regulation cursor 4A contacts the edge of the sheet S, and then the stopper 52 is inclined frontward in the first direction D1. In this way, the width direction regulation cursor 4A is stationarily held. In other words, the width direction regulation cursor 4A can be stationarily held at any position in the first direction D1. In this case, the frictional resistance, due to contact between the inner edge of the guide hole 521 and the guide shaft 51, can suppress positional deviation of the width direction regulation cursor 4A in the first direction D1.

In addition, in this embodiment, as the coil spring 53 biases the hole side end part 5201 backward in the first direction D1, the stopper 52 can be prevented from rising backward in the first direction D1. In this way, in the state where the width direction regulation cursor 4A contacts the sheet S (i.e., in the state where positional deviation of the width direction regulation cursor 4A in the first direction D1 is restricted), it is possible to suppress positional deviation of the width direction regulation cursor 4A in the first direction D1, due to unintentional rising of the stopper 52 backward in the first direction D1.

Here, in this embodiment, the biasing force of the coil spring 53 to bias the hole side end part 5201 to the back side in the first direction D1 is smaller than the frictional resistance generated when the inner edge of the guide hole 521 contacts the guide shaft 51. In this way, when the stopper 52 is inclined frontward in the first direction D1, it is possible to prevent the stopper 52 from being moved backward in the first direction D1 by the biasing force of the coil spring 53 while inclining frontward in the first direction D1. In other words, it is secured that the width direction regulation cursor 4A can be stationarily held.

In addition, in this embodiment, by allowing the operation side end part 5202 to protrude from the link opening 410 above the bottom surface part 41, and by inserting the link protrusion 411 in the link hole 522 from the back side in the first direction D1, even if the stopper 52 inclines frontward in the first direction D1, it is possible to prevent the linking between the width direction regulation cursor 4A and the stopper 52 from being released. In other words, even if the stopper 52 inclines frontward in the first direction D1, the link protrusion 411 is not detached from the link hole 522, and hence the linking between the width direction regulation cursor 4A and the stopper 52 is not released.

<Restriction of Inclination of Stopper>

The stopper 52 has a contact part 523 in an integrated manner. The stopper 52 has the contact part 523 as its part. The contact part 523 of the stopper 52 protrudes from the link opening 410 and is disposed at a higher position than the bottom surface part 41. The contact part 523 is a part that overhangs from the inner edge of the link opening 410 backward in the first direction D1. By bending a single metal sheet, the stopper 52 having the contact part 523 can be obtained.

Here, when the stopper 52 is raised backward in the first direction D1 from the state where it is inclined frontward in the first direction D1, so that the stopper 52 stands (or substantially stands), the contact part 523 contacts an upper surface of the bottom surface part 41. In other words, the state illustrated in FIG. 11 changes to the state illustrated in FIG. 12. When the stopper 52 is in the standing state, the frictional resistance due to contact between the inner edge of the guide hole 521 and the guide shaft 51 becomes smaller than that in the state where the stopper 52 is inclined frontward in the first direction D1, and hence the width direction regulation cursor 4A can move with the stopper 52 in the first direction D1.

In other words, in the state where the width direction regulation cursor 4A can move in the first direction D1, the contact part 523 contacts the upper surface of the bottom surface part 41 (i.e., the width direction regulation cursor 4A). By contacting the upper surface of the bottom surface part 41, the contact part 523 restricts the stopper 52 from inclining backward in the first direction D1, when the width direction regulation cursor 4A can move in the first direction D1.

In this embodiment, by providing the stopper 52 with the contact part 523, it is easy to keep the state where the width direction regulation cursor 4A can move in the first direction D1, and it is possible to prevent unintentional restriction of movement of the width direction regulation cursor 4A in the first direction D1. In other words, while enabling the width direction regulation cursor 4A to be stationarily held at any position in the first direction D1, it is possible to prevent lowering of operability when moving the width direction regulation cursor 4A. Note that this is convenient for the user because it is not necessary to be conscious about adjustment of force to be applied on the lever 61 described later.

In addition, by providing the stopper 52 with the contact part 523, it is not necessary to add another member for restricting inclination of the stopper 52 to the back side in the first direction D1. In this way, it is possible to prevent the structure from being complicated. In other words, cost increase can be suppressed.

<Operation of Stopper>

Figure 8:
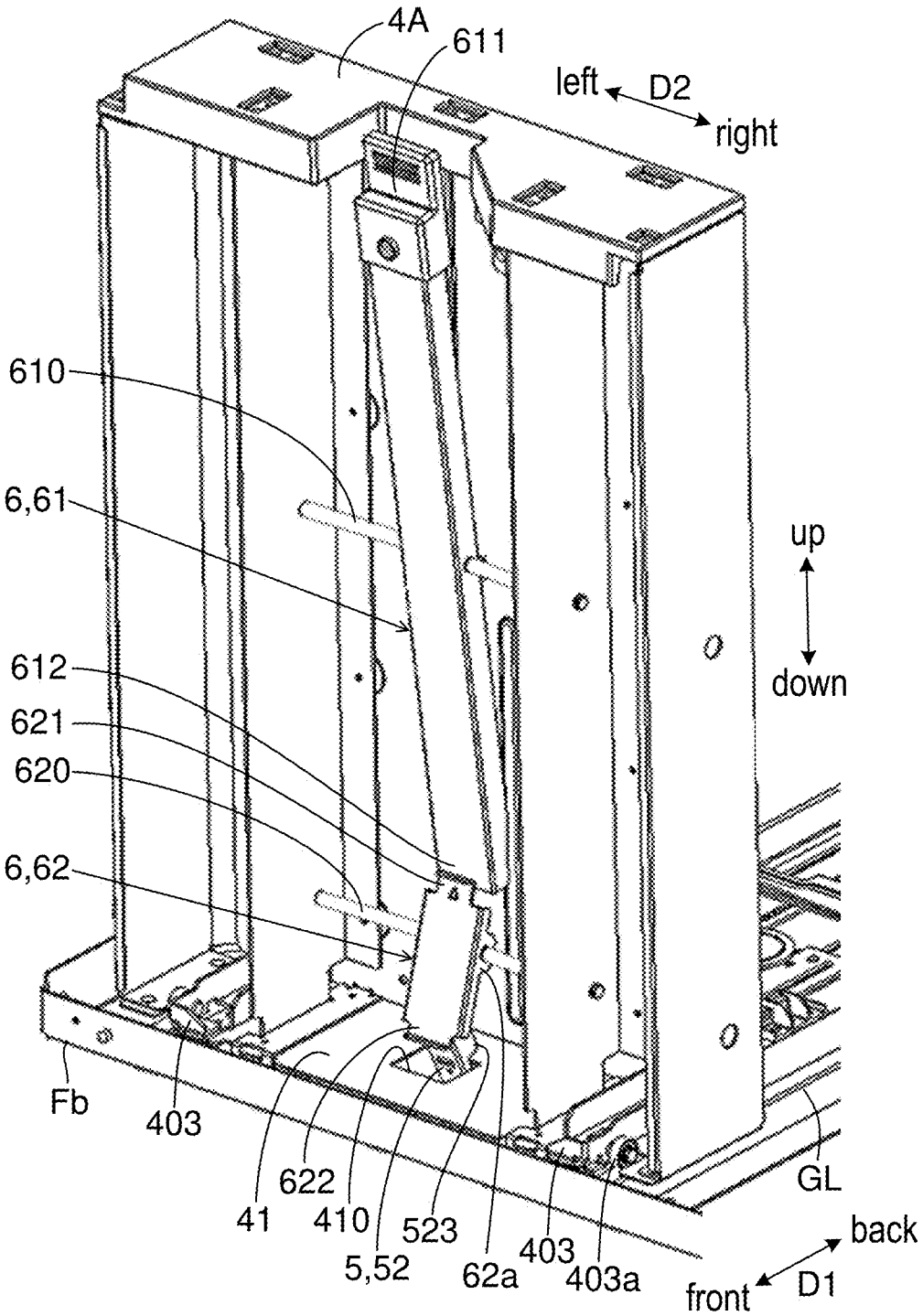
FIG. 8 is a perspective view of the width direction regulation cursors and their vicinity of the sheet storage device according to the embodiment, viewed from front.
Figure 9:
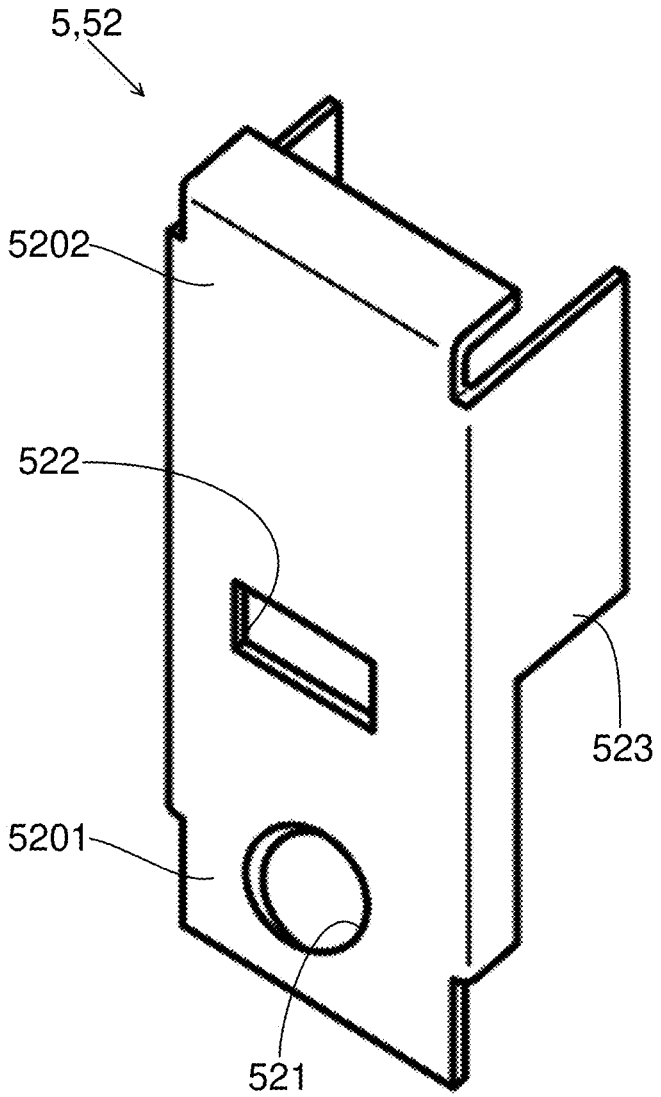
FIG. 9 is a perspective view of a stopper of the sheet storage device according to the embodiment.
Figure 10:
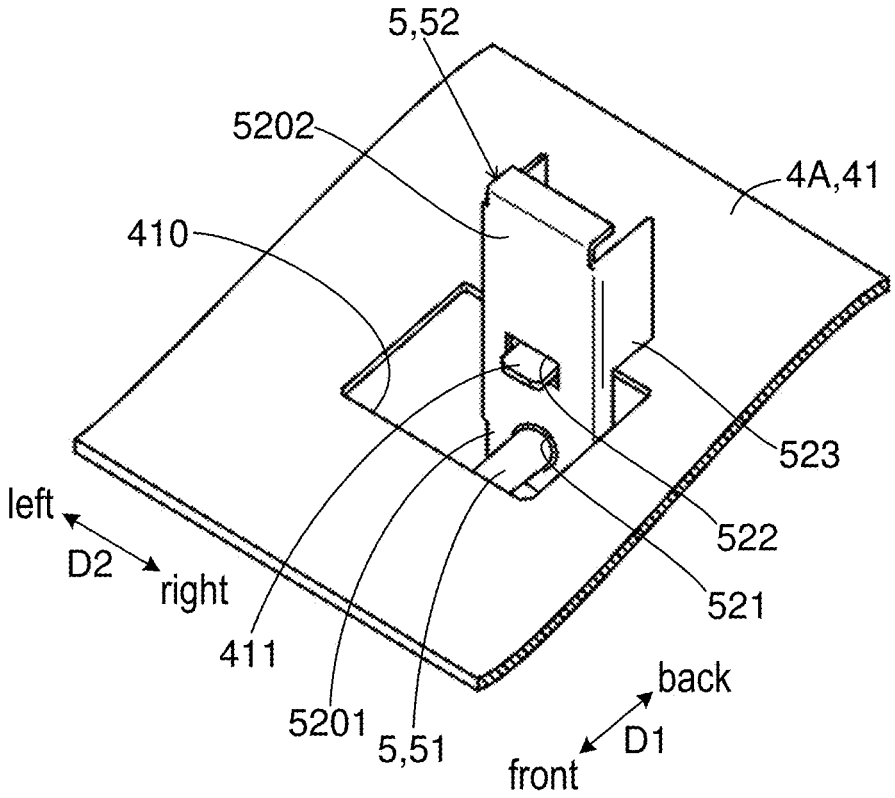
FIG. 10 is a perspective view of a state where the stopper illustrated in FIG. 9 is linked with the width direction regulation cursor.
Figure 12:
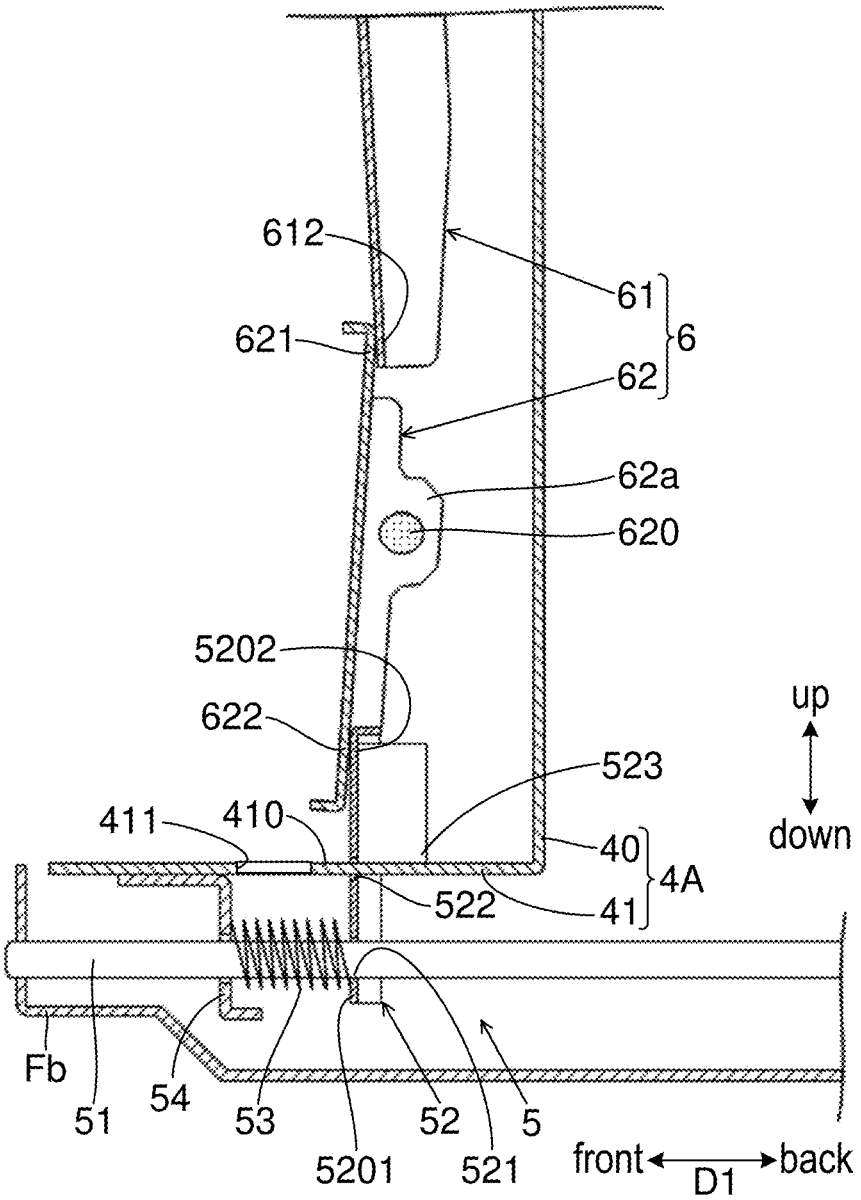
FIG. 12 is a cross-sectional view schematically illustrating a state where the stopper of the sheet storage device according to the embodiment is raised.

As illustrated in FIGS. 8, 11, and 12, the sheet storage device 100 includes an operation mechanism 6. The operation mechanism 6 is a mechanism for operating the stopper 52. The operation mechanism 6 is attached to the width direction regulation cursor 4A. The operation mechanism 6 is disposed outward of the width direction regulation cursor 4A in the first direction D1. The operation mechanism 6 includes the lever 61 and a relay member 62.

The lever 61 is supported by a rotation shaft 610 in a rotatable manner. The rotation shaft 610 is attached to the width direction regulation cursor 4A so as to extend in the second direction D2. In other words, the lever 61 is rotatable about an axis extending in the second direction D2. The lever 61 receives an operation by the user. By operating the lever 61, the width direction regulation cursors 4A and 4B can be moved in the first direction D1.

A position of an upper end part 611 of the lever 61 on an upper side of the rotation shaft 610 in the up and down direction is substantially the same as a position of an upper surface part of the width direction regulation cursor 4A in the up and down direction. The upper surface part of the width direction regulation cursor 4A has a recess (no numeral) that is recessed inward from the outside in the first direction D1. The upper end part 611 of the lever 61 is disposed inside the recess. In the operation of the lever 61, the upper end part 611 is moved. For instance, the upper end part 611 of the lever 61 is provided with a plastic grip. A lower end part 612 of the lever 61 on a lower side with respect to the rotation shaft 610 is disposed at a position capable of contacting the relay member 62.

The relay member 62 transmits a user's operation of the lever 61 to the stopper 52. The relay member 62 is supported by a rotation shaft 620 in a rotatable manner. The rotation shaft 620 is attached to the width direction regulation cursor 4A below the rotation shaft 610, so as to extend in the second direction D2. In other words, the relay member 62 is rotatable about an axis extending in the second direction D2. A position of the rotation shaft 620 in the first direction D1 is the same as a position of the rotation shaft 610 in the first direction D1.

The relay member 62 has a input end part 621 that is an upper side end part than the rotation shaft 620, and an output end part 622 that is a lower side end part than the rotation shaft 620. In other words, the relay member 62 has a support part 62*a* between the input end part 621 and the output end part 622. The support part 62*a* of the relay member 62 is supported in a rotatable manner about an axis extending in the second direction D2.

The lower end part 612 of the lever 61 contacts the input end part 621 from the back side in the first direction D1. The operation side end part 5202 of the stopper 52 contacts the output end part 622 from the back side in the first direction D1.

When moving the width direction regulation cursor 4A in the first direction D1, the user operates the lever 61. In this case, the upper end part 611 of the lever 61 is moved backward in the first direction D1. When the upper end part 611 of the lever 61 moves backward in the first direction D1, the lower end part 612 of the lever 61 moves frontward in the first direction D1.

Here, the lever 61 allows its lower end part 612 to contact the input end part 621 of the relay member 62 from the back side. Therefore, when the lower end part 612 of the lever 61 moves frontward in the first direction D1, the lower end part 612 of the lever 61 presses the input end part 621 frontward in the first direction D1. In other words, when the lever 61 is operated, it presses the input end part 621 frontward in the first direction D1. When the input end part 621 is pressed frontward in the first direction D1, the relay member 62 moves the output end part 622 backward in the first direction D1.

The relay member 62 allows its output end part 622 to contact the operation side end part 5202 of the stopper 52 from the front side in the first direction D1. Therefore, when the output end part 622 moves backward in the first direction D1, the output end part 622 presses the operation side end part 5202 backward in the first direction D1. In other words, when the lever 61 presses the input end part 621 frontward in the first direction D1, the relay member 62 presses the operation side end part 5202 backward in the first direction D1 by the output end part 622.

When the operation side end part 5202 is pressed backward in the first direction D1, the stopper 52 is raised backward in the first direction D1 from the state where it is inclined frontward in the first direction D1 (see FIG. 11). Finally, the stopper 52 becomes the standing state (see FIG. 12), and the contact part 523 of the stopper 52 contacts the upper surface of the bottom surface part 41. In this way, the stopper 52 is not further inclined backward in the first direction D1. In other words, the width direction regulation cursor 4A is maintained in the state where it can move in the first direction D1.

In this embodiment, as the operation mechanism 6 can adjust inclination of the stopper 52, it is easy to move the width direction regulation cursors 4A and 4B in the first direction D1, and it is possible to stationarily hold the width direction regulation cursors 4A and 4B at any position in the first direction D1. It is only necessary for the user to move the upper end part 611 of the lever 61, and hence operability can be improved.

<Stationarily Hold of Rear End Regulation Cursor>

Although not illustrated, the rear end regulation cursor 4C is linked with the hold mechanism 5, which has the same structure as the hold mechanism 5 linked with the width direction regulation cursor 4A. In other words, the rear end regulation cursor 4C also corresponds to the "regulation cursor". The width direction regulation cursor 4A corresponds to a "first regulation cursor", and the rear end regulation cursor 4C corresponds to a "second regulation cursor". In addition, focusing on the rear end regulation cursor 4C as the "regulation cursor", the right side in the second direction D2 corresponds to "one side in a predetermined direction", while the left side in the second direction D2 corresponds to "the other side in a predetermined direction".

In this structure, it is possible to regulate not only positional deviation of the width direction regulation cursors 4A and 4B in the first direction D1, but also positional deviation of the rear end regulation cursor 4C in the second direction D2. In other words, it is secured that the rear end regulation cursor 4C can be stationarily held at any position in the second direction D2. In addition, when the rear end regulation cursor 4C is moved in the second direction D2, movement of the rear end regulation cursor 4C in the second direction D2 is not unintentionally restricted. In this way, it is possible to suppress lowering of operability when moving the rear end regulation cursor 4C in the second direction D2.

The embodiment disclosed in this specification is merely an example in every aspect, and should not be interpreted as a limitation. The scope of the present disclosure is defined not by the above description of the embodiment but by the claims, and should be understood to include all modifications within meaning and scope equivalent to the claims.

What is claimed is:

1. A sheet storage device comprising:

a setting plate on which a sheet is set;

a regulation cursor supported in a manner capable of reciprocating in a horizontal direction, the regulation cursor being configured to contact an edge of the sheet on the setting plate from a predetermined direction, so as to regulate positional deviation of the sheet in the predetermined direction; and a hold mechanism configured to stationarily hold the regulation cursor, wherein the hold mechanism includes a guide shaft extending in the predetermined direction, and a stopper linked with the regulation cursor, the stopper having a guide hole in which the guide shaft is inserted, and being capable of reciprocating with the regulation cursor along the guide shaft, the stopper is capable of inclining to one side in the predetermined direction on a fulcrum of a hole side end part having the guide hole, when the stopper is inclined to the one side, an inner edge of the guide hole contacts the guide shaft so as to generate frictional resistance, which restricts movement of the regulation cursor with the stopper, and when the stopper is raised to the other side opposite to the one side from the state where movement of the regulation cursor is restricted, the regulation cursor is enabled to move with the stopper, the stopper has a contact part, and the contact part contacts the regulation cursor, so as to restrict the stopper from inclining to the other side, when the regulation cursor is enabled to move.

2. The sheet storage device according to claim 1, further comprising an operation mechanism for operating the stopper, wherein the operation mechanism includes a lever configured to receive an operation, and a relay member configured to transmit the operation of the lever to the stopper, the relay member includes an input end part for the lever to contact from the other side, an output end part for an operation side end part of the stopper on the opposite side of the hole side end part to contact from the other side, and a support part between the input end part and the output end part, the support part being supported in a rotatable manner about an axis extending in a direction perpendicular to the predetermined direction, when the lever is operated, it presses the input end part to the one side, and when the input end part is pressed to the one side, the relay member presses the operation side end part to the other side, by the output end part.

3. The sheet storage device according to claim 2, wherein the hold mechanism includes a biasing member, and the biasing member biases the hole side end part to the other side.

4. The sheet storage device according to claim 3, wherein a biasing force of the biasing member biasing the hole side end part to the other side is smaller than the frictional resistance.

5. The sheet storage device according to claim 2, wherein the regulation cursor includes a plate-like side surface part standing in an up and down direction, so as to contact the edge of the sheet on the setting plate from the predetermined direction, and a plate-like bottom surface part extending from a lower end of the side surface part to the one side, the guide shaft is disposed below the bottom surface part, the bottom surface part has a link opening penetrating the bottom surface part in the thickness direction, the link opening has a link protrusion protruding from an inner edge of the link opening to the one side, the stopper has a link hole between the hole side end part and the operation side end part, and by allowing the operation side end part to protrude from the link opening above the bottom surface part, and by inserting the link protrusion in the link hole from the other side, the stopper is linked with the regulation cursor.

6. The sheet storage device according to claim 5, wherein the stopper has the contact part at a part protruding from the link opening so as to be positioned above the bottom surface part, and the contact part overhangs from the inner edge of the link opening to the other side, and contacts an upper surface of the bottom surface part, so as to restrict the stopper from inclining to the other side.

7. The sheet storage device according to claim 1, wherein a first regulation cursor and a second regulation cursor are each linked to the hold mechanism, the first regulation cursor is supported in a movable manner in a first direction as the predetermined direction, so as to regulate positional deviation of the sheet in the first direction, and the second regulation cursor is supported in a movable manner in a second direction perpendicular to the first direction as the predetermined direction, so as to regulate positional deviation of the sheet in the second direction.

8. An image formation system comprising:

the sheet storage device according to claim 1; and an image forming apparatus linked with the sheet storage device, wherein the sheet storage device feeds the image forming apparatus with the sheet, and the image forming apparatus performs printing on the sheet fed from the sheet storage device.

* * * * *